United States Patent [19]

Maki et al.

[11] Patent Number: 4,857,267

[45] Date of Patent: Aug. 15, 1989

[54] ALUMINUM BASE BEARING ALLOY AND METHOD OF PRODUCING SAME

[75] Inventors: Yoshihiro Maki, Miura; Akira Matsuyama, Kamakura; Katsuji Tanizaki, Yokosuka; Noboru Okabe, Funabashi; Katsuhiro Kishida, Yokosuka; Takeshi Sakai, Chiba; Toshinaga Ohgaki, Yachiyo; Masahito Fujita, Funabashi, all of Japan

[73] Assignees: Nissan Motor Co., Ltd., Yokohama; NDC Co., Ltd., Naraschino, both of Japan

[21] Appl. No.: 104,595

[22] Filed: Sep. 29, 1987

Related U.S. Application Data

[62] Division of Ser. No. 934,861, Nov. 25, 1986, abandoned.

[30] Foreign Application Priority Data

Nov. 29, 1985 [JP] Japan ..... 60-268866

[51] Int. Cl.[4] ..... C22C 21/02; C22C 21/04

[52] U.S. Cl. ..... 419/31; 419/29; 419/41; 419/51; 419/55

[58] Field of Search ..... 419/29, 31, 41, 51, 419/55, 67

[56] References Cited

U.S. PATENT DOCUMENTS

| | | | |
|---|---|---|---|
| 2,966,735 | 1/1961 | Towner et al. | 75/249 |
| 3,076,706 | 2/1963 | Dauherty | 419/31 |
| 3,226,267 | 12/1965 | Foerster | 419/41 |
| 3,307,978 | 3/1967 | Foerster | 419/41 |
| 3,325,279 | 6/1967 | Lawrence et al. | 419/29 |
| 3,545,943 | 12/1970 | Miller et al. | 75/249 |
| 3,637,441 | 1/1972 | Lyle, Jr. et al. | 75/249 |
| 3,961,945 | 6/1976 | Sanders et al. | 75/249 |
| 3,964,935 | 6/1976 | Wilks | 75/249 |
| 4,135,922 | 1/1979 | Cebulak | 75/249 |
| 4,412,972 | 11/1983 | Mori | 420/530 |
| 4,435,213 | 3/1984 | Hildeman et al. | 75/249 |
| 4,537,167 | 8/1985 | Eudier et al. | 419/67 |
| 4,615,735 | 10/1986 | Ping | 75/249 |
| 4,647,321 | 3/1987 | Adam | 75/249 |
| 4,661,172 | 4/1987 | Skinner et al. | 75/249 |
| 4,702,885 | 10/1987 | Odani et al. | 419/67 |

FOREIGN PATENT DOCUMENTS

| | | | |
|---|---|---|---|
| 4830802 | 9/1973 | Japan | 75/249 |
| 58-171545 | 10/1983 | Japan . | |
| 58-193301 | 11/1983 | Japan | 75/249 |
| 59-150051 | 8/1984 | Japan | 75/249 |
| 1189279 | 4/1970 | United Kingdom | 75/249 |

*Primary Examiner*—Stephen J. Lechert, Jr.
*Assistant Examiner*—Eric Jorgensen
*Attorney, Agent, or Firm*—Foley & Lardner, Schwartz, Jeffery, Schwaab, Mack, Blumenthal & Evans

[57] ABSTRACT

The invention provides an aluminum base bearing alloy which is excellent in both lubricating capability and fatigue resistance and is useful, e.g. in automotive engines. The bearing alloy consists essentially of at least one lubricating element such as Pb and/or Sn the total amount of which is more than 0.04 and not more than 0.07 by sectional area ratio to the aluminum matrix, Si the amount of which is in the range from 0.01 to 0.17 by sectional area ratio to the aluminum matrix, 0.2–5.0 wt % of at least one reinforcing element such as Cu and/or Cr, 0–3.0 wt % of at least one refining element such as Ti and/or B and the balance of Al. The grain size of the lubricating element(s) is not larger than 8 μm, and the grain size of Si is not larger than 12 μm and preferably not smaller than 6 μm. The bearing alloy is produced by preparing a raw material alloy powder mixture in which Si grains are grown to the desired size by heat treatment, compacting the alloy powder mixture into a billet and extruding the billet at an extrusion ratio not lower than 10.

15 Claims, 3 Drawing Sheets

| ALLOY No. | | ENDURANCE TIME (hr) 50 100 150 | TYPE OF FAILURE |
|---|---|---|---|
| Ex. 5 | 21 | | peeling |
| | 22 | | peeling |
| | 23 | | peeling |
| | 24 | | not failed |
| | 25 | | not failed |
| | 26 | | not failed |
| | 27 | | peeling |
| Ex. 6 | 28 | | peeling |
| | 29 | | peeling |
| Comp. Ex. 2 | 31 | | local seizing |
| | 32 | | local cracking |
| | 33 | | shaft scuffing |

ALUMINUM BASE BEARING ALLOY AND METHOD OF PRODUCING SAME

This application is a division of application Ser. No. 934,861, filed Nov. 25, 1986, abandoned.

BACKGROUND OF THE INVENTION

This invention relates to an aluminum base bearing alloy which contains at least one soft, lubricating element such as Pb, Sn and/or Sb, Si as a hard element and at least one reinforcing element such as Cu and/or Cr and has improved fatigue resistance, and to a method of producing the bearing alloy.

Some kinds of copper base alloys such as Cu-Pb base alloys and Sn-Sb-Cu base alloys (Babbitt metal) have long been used as the bearing alloys for plain bearings in various machines. In recent years, lightweight aluminum base bearing alloys have been attracting increasing attention particularly for use in internal combustion engines in which bearing alloys are required to be high in heat resistance, wear resistance, corrosion resistance and fatigue resistance. Particularly, Al-Sn base and Al-Sn-Pb base bearing alloys are fairly better than other aluminum base alloys in the aforementioned endurance characteristics, so that proposals and practical applications of these bearing alloys are rapidly increasing. For example, Japanese patent application primary publication No. 58-171545 (1983) shows an Al-Pb-Sn base bearing alloy which contains Si as a hard component and at least one of Ni, Mn, Cr, V, Mg, Ti, Zn, Co and Zr as a reinforcing component and which is produced by compacting a powder mixture of the constituent elements and/or their alloys with aluminum or lead and extruding the compacted preform after heat treatment.

With the advancement and sophistication of internal combustion engines and particularly of automotive engines, severer conditions are enforced on the bearings in the engines. For example, widths of bearings are reduced as the gross size of the engine is reduced, and loads on bearings are increased as the engine output is increased. Accordingly still there is a strong demand for development of superior aluminum base bearing alloys. Especially it is keenly demanded that aluminum base bearing alloys should be improved in fatigue resistance since conventional aluminum base bearing alloys are liable to crack or locally peel off the backing metal within a period not long enough from a practical point of view.

To meet the aforementioned demand, in Japanese patent application primary publication No. 61-12844 published Jan. 21, 1986 we have disclosed an aluminum base bearing alloy which is excellent in both lubricating capability and fatigue resistance. This bearing alloy contains at least one of Pb, Sn, In, Sb and Bi as a lubricating component, Si as a hard component and at least one of Cu, Cr, Mg, Mn, Ni and Zn as a reinforcing component. The lubricating component is uniformly and finely dispersed in the aluminum matrix and amounts to 0.006–0.040 by sectional area ratio to the aluminum matrix, and the grains of this component are not larger than 8 μm. Si dispersed in the aluminum matrix amounts to 0.003–0.060 by sectional area ratio to the aluminum matrix and is not larger than 12 μm in grain size. The reinforcing component amounts to 0.2–5.0 wt%. The bearing alloy is required to be not lower than 15 kgf/mm$^2$ in tensile strength at normal temperature and not less than 13.5% in elongation at normal temperature. This bearing alloy is produced by compacting a mixture of raw material alloy powders into a billet and extruding the billet at a suitable temperature at an extrusion ratio not lower than 10.

The aluminum base bearing alloy according to JP 61-12844 exhibits excellent bearing characteristics so long as the lubricating oil is almost free from hard foreign matter. However, this bearing alloy is not very high in the ability to embed foreign matter and accordingly offers a problem that the bearing capability lowers when a considerable amount of foreign matter enters the lubricating oil. There is another problem. Sometimes and particularly when the mating material is cast iron, the aluminum base bearing alloy is scratched by the tiny burrs existing on the machined surface of the mating material mainly around the particles of free carbon.

In aluminum base bearing alloys containing Si as a hard element it is desirable that the grain size of Si is not excessively small from the viewpoint of enhancing wear resistance of the bearing alloy. In the case of producing a bearing alloy of this type by extrusion of a compacted alloy powder mixture, usually the extruded alloy needs to be subjected to a heat treatment to allow very fine grains of Si contained in the starting powder to a suitable level such as about 10 μm. However, this treatment is not very easy when the bearing alloy contains relatively large amounts of lubricating elements such as Pb and Sn because the heat treatment is liable to cause exudation of the low melting point lubricating elements such as Pb and Sn onto the alloy surface, which is known as a sweating phenomenon.

SUMMARY OF THE INVENTION

It is an object of the present invention to provide an aluminum base bearing alloy which is excellent in bearing characteristics including foreign matter embedability and also in fatigue resistance and is fully practicable even under severe conditions as enforced in recent automotive internal combustion engines.

It is another object of the invention to provide a good method of producing an aluminum base bearing alloy according to the invention.

The present invention provides an aluminum base bearing alloy which consists essentially of at least one lubricating element selected from Pb, Sn, In, Sb and Bi, the total amount thereof being more than 0.04 and not more than 0.07 by sectional area ratio to the aluminum matrix, a hard element which is Si and the amount of which is in the range from 0.01 to 0.17 by sectional area ratio to the aluminum matrix, 0.2–5.0 wt% of at least one reinforcing element selected from Cu, Cr, Mg, Mn, Ni, Zn and Fe, 0–3.0 wt% of at least one refining element selected from Ti, B, Zr, V, Ga, Sc, Y and the rare earth elements of atomic Nos. through 57 to 71 and the balance of A1. In the bearing alloy the grain size of the reinforcing element(s) is not larger than 8 μm, and the grain size of Si is not larger than 12 μm. The bearing alloy is required to be not lower than 12 kgf/mm$^2$ in tensile strength at normal temperature and not less than 11% in elongation at normal temperature. This bearing material must be produced extrusion of a preform or billet formed by compaction of an alloy powder at an extrusion ratio not lower than 10.

By comparison to the aluminum base bearing alloy shown in the Japanese publication No. 61-12844, an important feature of the bearing alloy according to the present invention is a considerable increase in the total amount of the lubricating element(s). Mainly for this reason the bearing alloy according to the invention is very improved in its foreign matter embedability, so that this bearing alloy long retains good bearing characteristics even when a considerable amount of hard foreign matter is present in the lubricating oil. In spite of the increased content of the low melting point lubricating element(s) the aforementioned sweating phenomenon can be avoided by performing the heat treatment for the growth of Si grains in the raw material in a suitable manner and at a suitable stage of the production process.

In the present invention it is preferred that the grain size of Si dispersed in the bearing alloy is in the range from 6 to 12 μm. Adjusting the Si grain size to such a moderate level is effective in enhancing wear resistance of the bearing alloy, so that even when the mating material is cast iron having tiny burrs on the machined surface the alloy is not easily scratched and, on the contrary, can remove burrs from the mating material.

For producing an aluminum base bearing alloy according to the invention the starting material is an alloy powder, which is fundamentally a mixture of at least two kinds of alloy powders and may contain some auxiliary elements of the bearing alloy each in the form of elemental metal powder. The alloy powder is compacted into a preform or billet by, for example, a cold hydrostatic pressing method, and the billet is extruded at an extrusion ratio not lower than 10 usually at a moderately elevated temperature. It is preferable to accomplish growth of Si grains by heat treatment precedent to the compaction of the alloy powder. The extrusion of the compacted raw material has the effect of breaking the oxide film on the surfaces of the individual particles of the alloy powder and dispersing the broken oxide film in the matrix of the extruded alloy. Therefore, the bearing alloy obtained by extrusion of the compacted alloy powder possesses good heat resistance like sintered aluminum products (SAP), and very strong adhesion between the powder particles is achieved.

An aluminum base bearing alloy according to the invention is far lower in specific gravity than conventional copper base bearing alloys, and this bearing alloy is excellent in both surface property or lubricating capability and fatigue resistance. That is, the present invention has succeeded in providing an aluminum base bearing alloy which well satisfies the antinomic requirements as to softness and strongness. This bearing alloy is fully practicable and has long service life even under such severe conditions as enforced in the recent automotive engines. Furthermore, this bearing alloy is good in foreign matter embedability so that the lubricating capability is not seriously deteriorated by the existence of some hard foreign matter in the lubricating oil.

Aluminum base bearing alloys according to the invention are very suitable for use in automobiles and other vehicles, machine tools, agricultural machines and so on as the primary material of bearings and other parts subject to sliding contact.

The present invention provides preferred methods for producing an aluminum base bearing alloy according to the invention.

A preferred first method comprises the steps of heating a powder of a first aluminum base alloy, which consists essentially of 8–12 wt% of Pb, 0.4–1.8 wt% of Sn, 1.0–15 wt% of Si, 0.2–5.0 wt% of at least one reinforcing element selected from Cu, Cr, Mg, Mn, Ni, Zn and Fe and the balance of Al, at a temperature in the range from 350° to 550° C. until the Si grains in the alloy powder grow to 6–12 μm, after the heating step mixing the first aluminum base alloy powder with a powder of a second aluminum base alloy which contains at least one lubricating element selected from Pb, Sn, In, Sb and Bi such that the resultant alloy powder mixture has the same chemical composition as the bearing alloy to be produced, compacting the alloy powder mixture into a billet, and extruding the billet at an extrusion ratio not lower than 10.

According to the need the second aluminum base alloy may additionally contain a relatively small amount of Si, at least one reinforcing element and/or at least one refining element. When the second aluminum base alloy contains Si, growth of Si grains contained in this alloy can be accomplished by annealing the extruded alloy at a suitable temperature or by heating the second alloy powder at 350°–550° C. before mixing with the first alloy powder.

A preferred second method comprises the steps of heating a powder of an Al-Si binary alloy containing 8–30 wt% of Si at a temperature in the range from 350° to 550° C. until the Si grains in the alloy powder grow to 6–12 μm, after the heating step mixing the Al-Si binary alloy powder with a powder of another aluminum base alloy which contains at least one lubricating element selected from Pb, Sn, In, Sb and Bi and at least one reinforcing element selected from Cu, Cr, Mg, Mn, Ni, Zn and Fe such that the resultant alloy powder mixture has the same chemical composition as the bearing alloy to be produced, compacting the alloy powder mixture into a billet, and extruding the billet at an extrusion ratio not lower than 10.

According to the need said another aluminum base alloy may additionally contain a relatively small amount of Si and/or at least one refining element. When this alloy contains Si, growth of Si grains contained in this alloy can be accomplished by annealing the extruded alloy at a suitable temperature or by heating this alloy powder at 350°–550° C. before mixing with the Al-Si alloy powder.

It is preferable that the amount of Si in an aluminum base bearing alloy according to the invention falls in the range from 0.01 to 0.08 by sectional area ratio to the aluminum matrix, particularly when producing the bearing alloy by the above stated second method.

DESCRIPTION OF THE PREFERRED EMBODIMENTS

Figure 1:
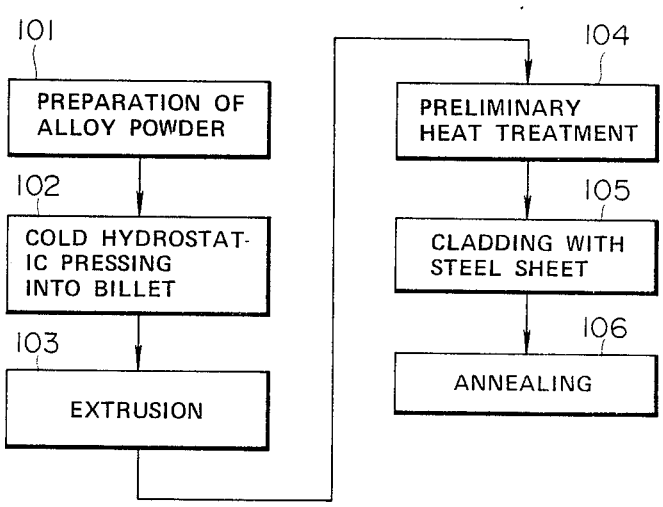
FIG. 1 is a flow chart showing the process of producing a bearing alloy according to the invention, employed in Example 1 of the invention.

In an aluminum base bearing alloy according to the invention, any one or any combination of Pb, Sn, In, Sb and Bi is used as a lubricating component.

These elements afford good anti-seizing property to the bearing alloy when they are finely and uniformly dispersed in the aluminum matrix. It is important that the total amount of the lubricating element(s) by sectional area ratio to the aluminum matrix should be more than 0.04 and not more than 0.07. If the total amount of the lubricating element(s) is not more than 0.04 by sectional area ratio the bearing alloy will not be very good in foreign matter embedability, and if the total amount of the same is more than 0.07 the bearing alloy will be insufficient in fatigue resistance and may not satisfy requirements on the bearing performance in respect of load endurance. It is preferable that the bearing alloy contains at least Pb and/or Sn. The grain sizes of the lubricating elements should not be larger than 8 μm because the expected anti-seizing effect cannot fully be obtained when the grain sizes are larger.

As a hard component of a bearing alloy according to the invention Si is dispersed in the aluminum matrix as either eutectic crystals or primary crystals to play the role of enhancing the mechanical strength and wear resistance of the bearing alloy. According to the invention it is suitable that Si amounts to from about 25% to about 250% of the above described lubricating component by sectional area. On this thought, the amount of Si in the bearing alloy is specified to be in the range from 0.01 to 0.17 by sectional area ratio to the aluminum matrix. If a larger amount of Si is contained the bearing alloy becomes brittle and inferior in machinability. In this invention the content of Si can be made higher than the upper boundary in the bearing alloys according to JP 61-12844 because of the increased amount of the lubricating component. When a bearing alloy according to the present invention and a bearing alloy according to JP 61-12844 contain the same amount of Si, the former bearing alloy is better in machinability. If the machinability of the latter bearing alloy is at a fully sufficient level, then it is possible to increase the content of Si in the former bearing alloy to thereby enhance mechanical strength and wear resistance without sacrificing machinability.

The grain size of Si dispersed in the bearing alloy should not be larger than 12 μm. If the grain size of Si is larger than 12 μm the bearing alloy is likely to damage a mating material and, bedies, becomes relatively low in wear resistance due to a decrease in the surface density of the dispersed Si. However, it is not desirable to unlimitedly reduce the grain size of Si. In the present invention it is preferred that the grain size of Si is in the range from 6 to 12 μm. We have experimentally confirmed that when the grain size of Si is smaller than 6 μm the bearing alloy is not high in its ability to remove small burrs from a mating material which may be a cast-formed and machine worked material.

The aluminum matrix of a bearing alloy according to the invention is reinforced by incorporating at least one reinforcing element selected from Cu, Cr, Mg, Mn, Ni, Zn and Fe which are often used as auxiliary alloying elements in aluminum alloys to be drawn or extruded. It is preferable to always use Cu for the reinforcing purpose since Cu is very effective in enhancing the creep strength, i.e. resistance to softening at high temperatures, of the bearing alloy and makes an important contribution to improvement in fatigue resistance of the bearing alloy under sliding contact conditions at high temperatures. Such effects of Cu remain insufficient when the content of Cu is less than 0.2 wt%. However, existence of more than 5.0 wt% of Cu renders the bearing alloy brittle and relatively low in fatigue resistance by reason of precipitation of a considerable amount of $CuAl_2$ in the form of needle-like crystals. Together with Cu, the bearing alloy may contain any one or any combination of Cr, Mg, Mn, Ni, Zn and Fe. In every case the total amount of the reinforcing element(s) in the bearing alloy should be in the range from 0.2 to 5.0 wt%.

In addition to the above described essential components a bearing alloy according to the invention may optionally contain at least one auxiliary element, which is selected from Ti, B, Zr, V, Ga, Sc, Y and rare earth elements of atomic Nos. through 57–71 and serves as a grain refining agent, for the purpose of assisting fine and uniform dispersion of the lubricating component. It is suitable that the total content of the refining element(s) in the bearing alloy is not more than 3.0 wt%. The minimum content of the same is not specified since the use thereof is an option though the total content needs to be at least 0.01 wt% for obtaining the expected effect.

A bearing alloy according to the invention is provided in the form of an extruded member, and the starting material is an alloy powder whose chemical composition is in agreement with the above described composition of the bearing alloy. The alloy powder may be a mixture of two or more kinds of alloys each of which is in powder form. It is essential to first compact the alloy powder into a billet of a suitable shape before performing extrusion. If the starting material is a powder mixture in which at least a part of the essential components of the bearing alloy is in the form of elemental metal powder, and if such a mixture is subjected to extrusion, the extruded member has not only surface defects but also interior cracks at the particle boundaries. By using an alloy powder not containing any elemental metal powder and compacting the alloy powder into a billet as a preform which is subjected to extrusion, it is possible to obtain a healthily extruded bearing alloy member. In the used alloy powder the individual particles are uniform, or not very different from one another, in hardness by comparison with a mixture of alloy powders and elemental metal powders. When a compact of the alloy powder is extruded, breaking of the oxide film on the surfaces of the alloy particles by friction between the particles will take place uniformly and will immediately be followed by metallic binding.

At extrusion of the aforementioned billet the extrusion ratio must be at least 10. At a lower extrusion ratio it is likely that the extruded bearing alloy member has interior defects and/or suffer from surface cracking and, therefore, it is difficult to obtain a practicable bearing alloy member. In this invention it is unnecessary to place a strict upper limit on the extrusion ratio. An arbitrary and considerably high extrusion ratio can be employed as far as extrusion is practicable and is within the capacity of available apparatus. If the alloy powder is directly subjected to extrusion without being compacted into a billet in advance it is difficult to obtain a practicable bearing alloy member because of occurrence of surface cracking and interior defects. By our experiments, it was impossible to obtain healthily extruded bearing alloy members by direct extrusion of an alloy powder even though the extrusion ratio was above 20. Therefore, it is indispensable to compact the alloy powder into a billet or preform as a step preliminary to extrusion. The compacting is accomplished by a suitable pressing method such as cold hydrostatic pressing or metal die molding.

The manner of extrusion of the billet is arbitrary. However, uniaxial forward extrusion with a vertical or horizontal extruder is most suitable in view of high productivity, ease of equipment maintenance and stable quality of the products. The extrusion temperature affects the hardness of the extruded bearing alloy, speed of extrusion and healthiness of the preform under extrusion. In general extrusion becomes easy as the extrusion temperature is higher. However, when the alloy preform contains relatively large amounts of soft and low melting point elements such as Pb and Sn, extrusion at an immoderately high temperature causes sweating of the soft elements and fails to give a good result. Therefore, suitable extrusion temperature should be selected with consideration of both the hardness of the alloy matrix in the particles of the raw material and the contents of low melting point elements in the same material. For example, in the case of alloy No. 1 described hereinafter and shown in Table 1 a suitable extrusion temperature is about 500° C., and for another alloy No. 3 (also shown in Table 1) containing larger amounts of low boiling point elements a suitable extrusion temperature is about 380° C. In general extrusion of a bearing alloy according to the invention is accomplished at 200°–600° C.

In a preferred first method of producing a bearing alloy according to the invention the starting material is a mixture of a first aluminum base alloy power and a second aluminum base alloy powder, as mentioned hereinbefore. It is suitable to prepare both the first and second alloy powders by an atomizing method.

The first aluminum base alloy, which provides a major portion of Si to be contained in the bearing alloy, contains 8–12 wt% of Pb, 0.4–1.8 wt% of Sn, 1.0–15 wt% of Si and 0.2–5.0 wt% of at least one reinforcing element selected from Cu, Cr, Mg, Mn, Ni, Zn and Fe. It is a requisite to a bearing alloy according to the invention that the grain size of Si contained as a hard element is not larger than 12 μm and, preferably, is in the range from 6 to 12 μm. However, in atomized powders of Si-containing aluminum base alloys the grain size of Si is usually as fine as about 3 μm or still finer. Therefore, in this method according to the invention the first alloy powder is subjected to heat treatment which causes the Si grains to grow to the extent of 6–12 μm. The heat treatment is performed at a temperature in the range from 350° to 550° C. At temperatures below 350° C. the heat treamtment requires a very long time and, therefore, is not practical. On the other hand, if the heat treatment temperature is above 550° C. a portion of Si grains will become too coarse and the crystal grains of the matrix will also coarsen.

In the first aluminum base alloy the content of Sn is limited to only 0.4–1.8 wt% with the intention of limiting the amount of Sn to 5–15% of coexisting Pb. This is because Sn is better than Pb in wettability with the aluminum matrix and, hence, is more liable to exhibit a sweating phenomenon at high temperatures and also because the existence of a small amount of Sn is desirable for prevention of corrosion of Pb. In the same alloy the content of Pb is specified to be 8–12 wt%. If the content of Pb in this alloy is less than 8 wt% the bearing alloy as the final product will be insufficient in its bearing characteristics, but if the content of Pb is more than 12 wt% it is likely that a sweating phenomenon occurs during the aforementioned heat treatment of the alloy powder. In the first alloy the contents of Si and the reinforcing element(s) are determined with consideration of the composition and bearing characteristics of the bearing alloy to be produced.

With the first aluminum base alloy powder alone, the total amount of the lubricating elements, viz. Pb and Sn, does not exceed 0.04 by sectional area ratio to the aluminum matrix. To produce an aluminum base bearing alloy in which the total amount of the lubricating elements is more than 0.04 and not more than 0.07 by sectional area ratio to the aluminum matrix, the first alloy powder is mixed with a powder of a second aluminum base alloy which contains at least one lubricating element selected from Pb, Sn, In, Sb and Bi together with Si and at least one reinforcing element selected from Cu, Cr, Mg, Mn, Ni, Zn and Fe. Optionally, the second alloy may contain at least one grain refining element selected from Ti, B, Zr, V, Ga, Sc, Y and rare earth elements of atomic Nos. through 57–71. The chemical composition of the second aluminum base alloy and the proportion of the second alloy powder to the first alloy powder are selectively determined such that the composition of the alloy powder mixture agrees with the composition of the bearing alloy to be produced.

If it is intended to obtain an aluminum base alloy in which Pb amounts to more than 0.04 by sectional area ratio to the aluminum matrix, more than 15 wt% of Pb must be added to Al due to the high specific gravity of Pb. However, it is almost impractical to use an aluminum base alloy powder containing such a large amount of Pb because in atomization of such an alloy it becomes necessary to make the temperature of the molten alloy as high as about 1200° C. for finely and uniformly dispersing the large amount of Pb in the aluminum matrix. Therefore, it is preferable to increase the sectional area ratio of the lubricating component of the finally obtained alloy by adding Sn in the form of an Al-Sn base alloy powder to the first alloy powder, rather than by adding Pb. It is undesirable to use an elemental Sn powder for the same purpose because of inferior dispersibility of the added Sn in the alloy matrix and insufficient bearing characteristics of the bearing alloy as the final product. By comparison, dispersibility of Sn added in the form of an atomized powder of an Al-Sn base alloy is far better. It is preferred to use an Al-Sn base alloy powder which contains at least 10 wt% of Sn so that the produced bearing alloy may possess good bearing characteristics and does not contain more than 20 wt% of Sn so that the subsequent hot extrusion may be accomplished without encountering a sweating phenomenon. To obtain an excellent bearing alloy it is preferable that the Al-Sn base alloy powder contains 1.0–15 wt% of Si, 0.2–5.0 wt% of at least one reinforcing element selected from Cu, Cr, Mg, Ni, Zn and Fe and, optionally a suitable amount of at least one grain refining element. Also it is effective for further improvement of the bearing characteristics of the finally obtained alloy to incorporate a small amount of Pb into the Al-Sn base alloy. In that case it is suitable to determine the content of Pb in the Al-Sn base alloy powder within the range from 1 to 4 wt% with consideration of the content of Sn in the same alloy so as not to cause a sweating phenomenon at the subsequent stage of hot extrusion.

In the above described first production method, particular care must be taken for avoiding a sweating phenomenon at the heat treatment of the first aluminum base alloy powder or at the extrusion of the compacted alloy powder mixture. In view of this matter, in a preferred second method of producing a bearing alloy according to the invention an Al-Si alloy powder containing no lubricating element is used as the sole source of Si. That is, an atomized powder of an Al-Si binary alloy containing 8–30 wt% of Si is used as the source of Si. Preparatorily, the Al-Si alloy powder is subjected to heat treatment so as to allow the Si grains to grow to the extent of 6–12 μm. It is suitable to preform the heat treatment at a temperature in the range from 350° to 550° C. Once the Si grains in the alloy powder have grown to 6–12 μm by the heat treatment, further growth of the Si grains hardly takes place during the process of producing a bearing alloy so long as the extrusion working of the raw material and annealing of the extruded product are performed at temperatures suitable for avoidance of a sweating phenomenon. Consequently the grain size of Si in the finally obtained bearing alloy remains at the desired level of 6–12 μm. The content of Si in the Al-Si binary alloy powder should be at least 8 wt% because otherwise it is difficult to produce a bearing alloy sufficiently high in wear resistance and should not be more than 30 wt% because otherwise it is difficult to stably accomplish atomization of the alloy mainly by reason of serious oxidation and also because the alloy powder becomes brittle.

In the finally obtained bearing alloy the amount of Si must be at least 0.01 by sectional ratio to the aluminum matrix. If the amount of Si is smaller the bearing alloy is insufficient in wear resistance. The maximum amount of Si in the bearing alloy is 0.17 by sectional area ratio to the aluminum matrix. If a larger amount of Si is contained the bearing alloy is unsatisfactory in its anti-seizing property. It is preferable to limit the amount of Si in the bearing alloy within the range from 0.01 to 0.08 by sectional area ratio because when the amount of Si is more than 0.08 it becomes necessary to use a very large amount of the Al-Si binary alloy powder. As mentioned hereinbefore the Al-Si binary alloy powder is mixed, after the heat treatment, with a powder of another aluminum base alloy which contains suitable amounts of at least one lubricating element, at least one reinforcing element and, optionally, at least one grain refining element, such that the composition of the alloy powder mixture agrees with the composition of the bearing alloy to be produced. The alloy powder mixture is compacted into a billet, and the billet is extruded at an extrusion ratio not lower than 10.

The invention is further illustrated by the following nonlimitative examples.

EXAMPLE 1

Seven kinds of aluminum base alloys, viz Nos. 1 to 7, of the compositions shown in Table 1 were prepared by melting raw materials at 950°–1000° C. in an electric furnace.

Each alloy was processed in the manner as illustrated in FIG. 1. First at step 101, an alloy powder consisting of −18 mesh particles was produced from the molten alloy by an air atomizing method. At step 102 the alloy powder was compacted into a cylindrical billet 100 mm in diameter and 100 mm in length by a cold hydrostatic pressing method. The hydrostatic pressure was 2000 kgf/cm$^2$. At step 103 the billet was subjected to forward extrusion to obtain an alloy sheet which was 60 mm in width and 1.6 mm in thickness. The extrusion temperature was variable within the range from 250° to 550° C. depending on the chemical composition of the alloy. Specimens of the extruded alloy were subjected to tensile test at normal temperature. The results are shown in Table 1. The next step 104 was heat treatment of the extruded alloy sheet preparatory to a cladding operation. At step 105 the alloy sheet was cladding with a steel sheet empolyed as the backing metal by rolling the two sheets together. At step 106 the bearing material obtained by the cladding was annealed at 400° C. for about 6 hr.

TABLE 1

| Alloy No. | Alloying Elements: lubricating elements (sectional area ratio to Al matrix) Pb | Sn | In | Sb | Bi | Si | reinforcing elements (wt %) Cu | Cr | Mg | Mn | Ni | Zn | grain refining elements (wt %) Ti | B | Zr | V | Ga | misch metal | Mechanical Properties of Extruded Alloy: Tensile Strength (kgf/mm$^2$) | Elongation (%) |
|---|---|---|---|---|---|---|---|---|---|---|---|---|---|---|---|---|---|---|---|---|
| 1 | 0.04 | — | 0.001 | — | — | 0.01 | 0.7 | — | — | — | — | — | — | — | — | — | — | — | 14.1 | 15.1 |
| 2 | 0.03 | 0.04 | — | — | — | 0.06 | 0.7 | — | — | — | — | — | — | — | 0.5 | — | — | — | 14.3 | 13.9 |
| 3 | 0.03 | 0.03 | — | 0.005 | 0.005 | 0.17 | 0.7 | — | — | — | — | — | — | 0.1 | — | 0.2 | — | — | 14.9 | 11.9 |
| 4 | 0.03 | 0.02 | 0.001 | — | — | 0.13 | 0.7 | 0.25 | 0.25 | 0.25 | 0.25 | 0.4 | — | — | — | — | — | — | 17.5 | 12.1 |
| 5 | 0.04 | 0.005 | — | 0.005 | — | 0.04 | 0.4 | — | — | — | — | — | 0.01 | — | — | — | 0.01 | — | 12.9 | 15.5 |
| 6 | 0.035 | 0.015 | — | — | 0.001 | 0.04 | 0.6 | — | — | — | — | — | — | — | — | — | — | 3.0 | 13.9 | 14.7 |
| 7 | 0.04 | — | 0.001 | — | — | 0.01 | 0.7 | — | — | — | — | — | 0.01 | — | — | — | — | — | 14.3 | 15.3 |
| 11 | 0.03 | 0.005 | — | — | — | 0.10 | 0.7 | — | — | — | — | — | 0.1 | 0.1 | — | — | — | — | 14.9 | 13.8 |
| 12 | 0.04 | 0.04 | — | — | 0.001 | 0.10 | 0.7 | — | — | — | — | — | — | — | — | — | — | — | 11.2 | 10.7 |
| 13 | 0.03 | 0.04 | — | — | — | 0.06 | 0.7 | — | — | — | — | — | — | — | 0.5 | — | — | — | 14.0 | 13.5 |
| 14 | 0.03 | 0.03 | — | 0.005 | 0.005 | 0.17 | 0.7 | — | — | — | — | — | — | 0.1 | — | 0.2 | — | — | 14.4 | 11.0 |

NOTES
Grain size of the soft (lubricating) phase: ≦ 8 μm in alloy Nos. 1 to 12 and No. 14, 10–15 μm in No. 13.
Grain size of Si: ≦ 12 μm in alloy Nos. 1 to 13, 14–20 μm in No. 14.

The thus produced seven kinds of bearing materials, Nos. 1 to 7, were respectively machined into sample bearings, which were subjected to a fatigue resistance test under the following severe conditions.

Dimensions of Bearing: 54 mm in width, 12 mm in length, 1.5 mm in thickness.

Bearing United Load: 600 kgf/cm$^2$

Revolutions: 3750 rpm

Lubricating Oil: SAE 20W–40

Oil Temperature: 120° C.

Oil Feed Pressure: 4.0 kgf/cm$^2$

Foreign Matter in Oil: Fe chip powder (−145 mesh), 200 mg/l

Test Time: up to 200 hr

Shaft Material: machine structural carbon steel S45C

Shaft Surface Roughness ($R_{max}$): 0.8 μm

Shaft Hardness (HrC): about 55

Figure 2:
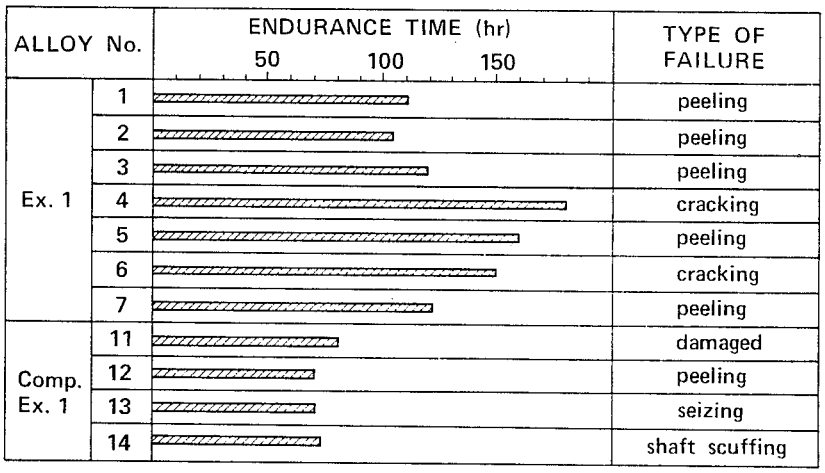
FIG. 2 is a chart showing the results of a fatigue resistance test on several kinds of bearing alloys produced in Example 1 and Comparative Example 1.

FIG. 2 shows the results of the bearing fatigue test.

COMPARATIVE EXAMPLE 1

Four kinds of aluminum base alloys, viz. Nos. 11 to 14, of the compositions shown in Table 1 were prepared by the same method as in Example 1.

The alloy No. 11 was low in the total content of the lubricating elements, and the alloy No. 12 was excessively high in the content of the same elements. These two kinds of alloys were each processed in the manner as illustrated in FIG. 1 and described in Example 1, and the obtained bearing materials were each machined into sample bearings which were subjected to the above described fatigue test. The test results are shown in FIG. 2.

The alloy No. 13 was similar in chemical composition to the alloy No. 2 of Example 1, but the alloy No. 13 was larger in the grain size of the soft, lubricating phase. The alloy No. 14 was similar in chemical composition to the alloy No. 3 of Example 1 and was larger in the grain size of Si. By the steps 101 to 103 shown in FIG. 1 and described in Example 1, each of the alloys Nos. 13 and 14 was processed into an extruded sheet 60 mm in width and 1.6 mm in thickness. The alloy sheet was cladding with a pure aluminum sheet 62 mm in width and 0.4 mm in thickness so as to obtain a two-layer bearing alloy sheet having a thickness of 1.2 mm. After annealing at 400° C. for 6 hr the two-layer alloy sheet was cladding with a 2 mm thick steel sheet whose surface had been roughened in advance, and rolling as carried out until the total thickness of the cladding laminate reduced to 1.8 mm. After that the laminate was annealed at 400° C. for 6 hr to thereby obtain a three-layer bearing alloy material including a backing steel sheet. These two kinds of bearing materials, Nos. 13 and 14, were respectively machined into sample bearings which were subjected to the fatigue test described in Example 1. The test results are shown in FIG. 2.

As can be seen in Table 1 and FIG. 2, the bearing alloys Nos. 1 to 7 according to the invention all exhibited good mechanical properties at the stage of extrusion and, as bearings, were all excellent in both fatigue resistance and foreign matter embedability.

The bearing alloy No. 11, which resembled the bearing alloys according to JP 61-12844, was excellent in mechanical properties at the stage of extrusion. However, at the fatigue test the bearing of the alloy No. 11 was seriously damaged by the Fe chip powder contained in the lubricating oil so that the fatigue test had to be terminated in about 80 hr. Such insufficiency in the foreign matter embedability was attributed to smallness of the total amount of the lubricating elements, Pb and Sn in this case. The bearing alloy No. 12 containing increased amounts of lubricating elements was not good in mechanical properties at the stage of extrusion and was very low in fatigue resistance as bearings.

In the case of the bearing alloy No. 13 in which the grain size of the soft phase was larger, seizure of the bearing on the mating shaft occurred during the fatigue test. In the case of the bearing alloy No. 14 in which the Si grain size was larger, serious scuffing of the mating shaft occurred during the bearing fatigue test.

EXAMPLE 2

The alloy No. 3 shown in Table 1 was processed into a 60 mm wide and 1.6 mm thick sheet by the atomizing, compacting and extruding steps 101 to 103 shown in FIG. 1 and described in Example 1. The erxtrusion temperature was 350° C., and the extrusion ratio was 80. The extruded alloy sheet was cladding with a 2 mm thick steel sheet after removing the surface layer of the steel sheet by treatment with a grinding belt. The cladding laminate was subjected to rolling until its total thickness reduced to 1.8 mm. After that the laminate was annealed at 400° C. for 6 hr to further enhance adhesion between the rolled bearing alloy and the backing steel sheet and also to remedy work straining of the rolled bearing alloy. By examination under microscope it was confirmed that the cladding and annealing did not produce a significant change in the structure of the bearing alloy. By examination with an electron microscope it was found that in the rolled bearing alloy the soft elements (Pb, Sn, Sb, and Bi) were uniformly and finely dispersed in the aluminum matrix, and the grain sizes of these elements were not larger than 8 μm.

EXAMPLE 3

The alloy No. 1 shown in Table 1 was processed into a 1.6 mm thick sheet by the same steps as in Example 2. In ths case the extrusion temperature was 500° C. The extruded alloy sheet was cladding with a 2 mm thick steel sheet having a 2 μm thick Ni coating film formed by plating, and the laminate was rolled until its total thickness reduced to 2 mm. After that the laminate was annealed at 400° C. for 6 hr. By examination under microscope it was confirmed that the cladding and annealing did not produce a significant change in the structure of the bearing alloy. By examination with an electron microscope, the soft elements in the rolled bearing alloy dispersed uniformly and finely and were not more than 6 μm in their grain sizes.

The above described experiment was repeated by using the alloy No. 7 in place of the alloy No. 1. As can be seen in Table 1, the alloy No. 7 was obtained by adding 0.01 wt% of Ti, i.e. a grain refining element, to the alloy No. 1. Also in this case there was not a significant difference in the structure of the bearing alloy before and after the cladding and annealing, and in the rolled bearing alloy the soft elements were uniformly and finely dispersed. As to the effect of the addition of Ti, the grain sizes of the soft elements in the rolled bearing alloy No. 7 were not larger than 4 μm.

EXAMPLE 4

The alloy No. 2 shown in Table 1 was processed into a 1.6 mm thick sheet by the same steps as in Example 2. The extruded alloy sheet was cladding with a pure aluminum sheet 62 mm in width and 0.4 mm in thickness so as to obtain a two-layer laminate having a thickness of 1.2 mm. After annealing at 400° C. for 6 hr the two-layer laminate was cladded with to a 2 mm thick steel sheet having a roughened surface, and rolling was carried out until the total thickness of the three-layer laminate reduced to 1.8 mm. After that the laminate was annealed at 400° C. for 6 hr. By examination under microscope there was not a significant difference in the structure of the bearing alloy before and after the cladding. In the bearing alloy the lubricating elements were uniformly and finely dispersed and were not larger than 8 μm in grain size.

In the foregoing Examples 1–4 a sheet of a bearing alloy according to the invention was cladding with a backing metal steel sheet directly, or with interposition of a plated Ni layer or a thin Al sheet as an adhesion assisting layer. In practical applications of this invention it is optional to employ such an adhesion assisting means with consideration of related factors such as the composition of the bearing alloy, particulars of the bearing manufacturing method and costs, and it is also possible to employ a different material such as an Al powder or Co plating.

Also it is optional to make heat treatment of the extrucded bearing alloy before cladding it with a backing metal. Depending on the conditions of cladding, the reduction ratio may be increased by performing preparatory heat treatment of the extruded bearing alloy.

EXAMPLE 5

Example 5 includes seven kinds of aluminum base bearing alloys, viz. Nos. 21 to 27 the particulars of which are shown in Table 2. Each of these alloys was prepared by first mixing an aluminum base alloy powder (I) with another aluminum base alloy powder (II). As shown in Table 2 the compositions of the aluminum base alloys (I) and (II) were variable. (In every case the alloys (I) and (II) consisted essentially of the alloying elements named in Table 2 and the balance of Al.) In every case the aluminum base alloys (I) and (II) were each melted at 950°-1000° C. in an electric furnace, and the molten metal was atomized in air to obtain alloy powder consisting of −18 mesh particles. In every case the alloy powder (I) was subjected to a heat treatment to cause at least a major portion of Si grains contained therein to grow to the extent of 6-12 μm. Then the alloy powders (I) and (II) were mixed together in the proportion shown in Table 2, and the alloy powder mixture was compacted into a cylindrical billet 100 mm in diameter and 100 mm in length by a cold hydrostatic pressing method. The hydrostatic pressure was 2000 kgf/cm$^2$.

plished without causing the sweating phenomenon. The extrusion ratio was more than 10. The next step 112 was heat treatment of the extruded alloy plate preparatory to a rolling operation. At step 113 the alloy plate was rolled for reduction in thickness, and at step 114 the rolled alloy sheet was annealed. At step 115 the alloy sheet was preliminarily cladded with a pure Al sheet, followed by annealing at step 116. The thus precladded alloy sheet was cladded, at step 117, with a steel sheet employed as the backing metal such that the aluminum cladding interposed between the bearing alloy layer and the steel sheet. At step 118 the bearing material obtained by the cladding was annealed. At step 119 the bearing material was machined into sample bearings.

In the bearing alloys Nos. 21 to 27 produced in this example the sectional area ratios of Pb, Sn and Si to the Al matrix were as shown in Table 2. In these bearing alloys the grain sizes of the lubricating elements were not larger than 8 μm.

The sample bearings were 54 mm in width, 12 mm in length and 1.5 mm in thickness. These sample bearings were subjected to a fatigue resistance test under the following severe conditions.

Bearing United Load: 600 kgf/cm$^2$
Revolutions: 3750 rpm
Lubricating Oil: SAE 20W-40
Oil Feed Temperature: 120° C.
Oil Feed Pressure: 4.0 kgf/cm$^2$
Test Time: up to 200 hr
Shaft Material: nodular graphite cast iron FCD70
Shaft Surface Roughness ($R_{max}$): 1.2 μm
Shaft Hardness ($H_B$): about 310

Figures 3, 4:
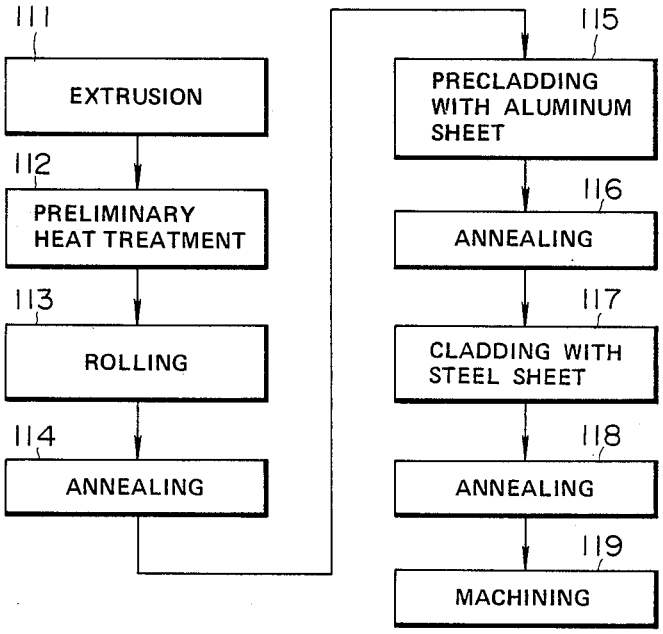
FIG. 3 is a flow chart showing the process of working an extruded bearing alloy into a bearing, employed in Example 5 of the invention.
FIG. 4 is a chart showing the results of fatique resistance test on several kinds of bearings alloys produced in Examples 5 and 6 and Comparative Example 2.

FIG. 4 shows the results of the bearing fatigue test.

EXAMPLE 6

TABLE 2

| Alloy No. | Alloying Elements in Atomized Aluminum Alloy Powders (wt %) Al Alloy Powder (I) Pb | Sn | Si | Other | Al Alloy Powder (II) Pb | Sn | Si | other | Mixing Ratio (wt %) (I) | (II) | Bearing Alloy sectional area ratio to matrix Pb | Sn | Si | Si grain size (μm) | Note |
|---|---|---|---|---|---|---|---|---|---|---|---|---|---|---|---|
| 21 | 10 | 1.0 | 8 | Cu: 0.75 | — | 18 | — | — | 50 | 50 | 0.014 | 0.037 | 0.047 | 6-12 | alloy powder (I) was heat-treated for growth of Si grains |
| 22 | 10 | 1.0 | 8 | Cu: 0.75 | — | 18 | — | — | 70 | 30 | 0.017 | 0.024 | 0.062 | 6-12 | " |
| 23 | 10 | 1.0 | 8 | Cu: 0.75 | — | 18 | — | — | 10 | 90 | 0.0024 | 0.066 | 0.01 | 6-12 | " |
| 24 | 10 | 1.0 | 8 | Cr: 0.5<br>Cu: 0.75 | — | 18 | 4 | Cr: 0.5<br>Cu: 0.75 | 50 | 50 | 0.014 | 0.037 | 0.07 | 6-12 ca. 2/3<br><3 ca. 1/3 | " |
| 25 | 10 | 1.0 | 8 | Cr: 0.5<br>Cu: 0.75<br>Zn: 3.0 | 2 | 18 | 4 | Cr: 0.5<br>Cu: 0.75<br>Zn: 3.0 | 50 | 50 | 0.016 | 0.037 | 0.07 | 6-12 ca. 2/3<br><3 ca.1/3 | " |
| 26 | 12 | 1.8 | 4 | Cr: 0.5<br>Cu: 0.75 | 2 | 12 | 2 | Cr: 0.5<br>Cu: 0.75 | 30 | 70 | 0.014 | 0.035 | 0.03 | 6-12 ca. 2/3<br><3 ca. 1/3 | " |
| 27 | 8 | 0.4 | 4 | Cr: 0.5<br>Cu: 0.75 | 2 | 12 | 2 | Cr: 0.5<br>Cu: 0.75 | 30 | 70 | 0.009 | 0.033 | 0.03 | 6-12 ca. 2/3<br><3 ca. 1/3 | " |
| 28 | 10 | 1.0 | 8 | Cu: 0.75 | — | 18 | — | — | 70 | 30 | 0.017 | 0.024 | 0.062 | 3-6 ca. ½<br><3 ca. ½ | "; but under different condition |
| 29 | 12 | 1.8 | 4 | Cr: 05<br>Cu: 0.75 | 2 | 12 | 2 | Cr: 0.5<br>Cu: 0.75 | 30 | 70 | 0.014 | 0.035 | 0.03 | <3 | heat treatment of alloy powder (I) was omitted |
| 31 | 12 | 1.8 | 4 | Cr: 0.5<br>Cu: 0.75 | 2 | 12 | 2 | Cr: 0.5<br>Cu: 0.75 | 30 | 70 | 0.014 | 0.035 | 0.03 | 6-12 ca. 2/3<br><3 ca. 1/3 | alloy powder (I) was heat-treated |
| 32 | 12 | 1.8 | 4 | Cr: 0.5<br>Cu: 0.75 | 2 | 12 | 2 | Cr: 0.5<br>Cu: 0.75 | 30 | 70 | 0.014 | 0.035 | 0.03 | 6-12 ca. 2/3<br><3 ca. 1/3 | " |
| 33 | 10 | 1.0 | 8 | Cu: 0.75 | — | 18 | — | — | 70 | 30 | 0.017 | 0.024 | 0.062 | 14-20 | "; but under different condition |

FIG. 3 illustrates the process of producing sample bearings for each of the alloys Nos. 21 to 27. At step 111 the aforementioned cylindrical billet was extruded into an alloy plate at a suitable temperature within the range from 200° to 400° C., depending on the contents of Pb and Sn in the alloy, so that extrusion could be accom- This example is supplemental to Example 5 and relates to aluminum base bearing alloys Nos. 28 and 29 the particulars of which are shown in Table 2. The alloy No. 28 was similar in chemical composition to the alloy No. 22 of Example 5 and was smaller in the grain size of Si. The modification was accomplished by varying the condition of the heat treatment of the aluminum base alloy powder (I). The alloy No. 29 was similar in chemical composition to the alloy No. 26 of Example 5 and was very smaller in the grain size of Si since heat treatment of the aluminum base alloy powder (I) was omitted. Except the modification in this point, the alloys Nos. 28 and 29 were produced and processed in the manner illustrated in FIG. 3 and described in Example 5, and the sample bearings were subjected to the fatigue test described in Example 5. The test results are shown in FIG. 4.

COMPARATIVE EXAMPLE 2

Three kinds of aluminum base bearing alloys, viz. Nos. 31 to 33 of the particulars shown in Table 2, were prepared and processed in accordance with Example 5 except the following modifications.

The alloy No. 31 and the alloy No. 32 were similar in chemical composition to the alloy No. 26 of Example 5. In the case of the alloy No. 31 the raw materials were changed so that the grain sizes of the lubricating elements were 10–15 μm. In the case of the alloy No. 32 the extrusion ratio was decreased to 8. The alloy No. 33 was similar in chemical composition to the alloy No. 22 of Example 5 and was larger in the grain size of Si.

Sample bearings of the alloys Nos. 31 to 33 were subjected to the fatigue test described in Example 5. The test results are shown in FIG. 4.

As can be seen in FIG. 4, the bearing alloys Nos. 21 to 27 produced by the preferred first method according to the invention were excellent in fatigue resistance and durability. By comparison, the bearing alloys Nos. 28 and 29 were lower in fatigue resistance by reason of insufficiency or omission of the growth of Si grains. The comparative bearing alloys Nos. 31, 32 and 33, which are remarked above, all proved to be inferior in durability or conformability.

EXAMPLE 7

Example 7 includes seven kinds of aluminum base bearing alloys, viz. Nos. 41 to 47 the particulars of which are shown in Table 3. Each of these alloys was prepared by first mixing an aluminum base alloy powder (I) with an aluminum-silicon alloy powder (II). As shown in Table 3 the compositions of the alloys (I) and (II) were variable. In every case the alloy (I) consisted essentially of at least one lubricating element, at least one reinforcing element and the balance of Al. The alloy (I) was prepared by melting the raw materials at 950°–1000° C. in an electric furnace, and the molten alloy was atomized in air to obtain alloy powder (I) consisting of −18 mesh particles. In every case the alloy (II) was and Al-Si binary alloy prepared by melting at or slightly above 750° C. in an electric furnace, and the molten alloy was atomized in air to obtain alloy powder (II) consisting of −18 mesh particles. In every case the alloy powder (II) was heat treated at 350°–550° C. to allow Si grains to grow to the extent of 6–12 μm. Then the alloy powders (I) and (II) were mixed together in the proportion shown in Table 3, and the alloy powder mixture was compacted into a cylindrical billet 100 mm in diameter and 100 mm in length by a cold hydrostatic pressing method. The hydrostatic pressure was 2000 kgf/cm$^2$.

TABLE 3

| Alloy | Alloying Elements in Atomized Aluminum Alloy Powders | | | | | | | | | | | | | | | Bearing Alloy | | | |
|---|---|---|---|---|---|---|---|---|---|---|---|---|---|---|---|---|---|---|---|
| | Al Alloy Powder (I) | | | | | | | | | | | | Al—Si Alloy Powder (II) Si | Mixing Ratio (wt %) | | lubricating elements (sectional area ratio to Al matrix) | Si | reinforcing elements (wt %) | Si grain size |
| | lubricating elements (sectional area ratio to Al matrix) | | | | | | reinforcing elements (wt %) | | | | | | | | | | | | |
| No. | Pb | Sn | Sb | Bi | In | Si | Cr | Cu | Zn | Mn | Ni | Mg | (wt %) | (I) | (II) | | | (wt %) | (μm) |
| 41 | 0.03 | 0.02 | — | — | — | — | 0.6 | 0.8 | — | — | — | — | 10 | 90 | 10 | 0.045 | 0.012 | 1.26 | 6–12 |
| 42 | 0.03 | 0.02 | — | — | — | — | 0.6 | 0.8 | — | — | — | — | 25 | 90 | 10 | 0.045 | 0.029 | 1.26 | 6–12 |
| 43 | 0.03 | 0.02 | 0.01 | — | — | — | 0.6 | 0.8 | — | — | — | — | 25 | 75 | 25 | 0.045 | 0.07 | 1.05 | 6–12 |
| 44 | 0.03 | 0.02 | — | 0.01 | — | — | — | 0.7 | — | — | — | — | 20 | 90 | 10 | 0.054 | 0.023 | 0.63 | 6–12 |
| 45 | 0.03 | 0.02 | 0.01 | — | — | — | 0.6 | 0.8 | 3.6 | — | — | — | 20 | 90 | 10 | 0.054 | 0.023 | 4.50 | 6–12 |
| 46 | 0.03 | 0.03 | — | — | 0.01 | — | — | 0.4 | 3.2 | 0.4 | 1.0 | — | 20 | 90 | 10 | 0.063 | 0.023 | 4.50 | 6–12 |
| 47 | — | 0.06 | — | — | — | — | — | 0.8 | 2.0 | — | — | 0.2 | 20 | 85 | 15 | 0.051 | 0.034 | 2.55 | 6–12 |
| 48 | 0.03 | 0.03 | — | — | 0.01 | 0.023 | — | 0.4 | 3.2 | 0.4 | 1.0 | — | — | 100 | — | 0.07 | 0.023 | 5.00 | <3 |
| 51 | 0.03 | 0.02 | — | — | — | — | 0.6 | 0.8 | — | — | — | — | 25 | 90 | 10 | 0.45 | 0.029 | 1.26 | 6–12 |
| 52 | 0.03 | 0.02 | — | — | — | — | 0.6 | 0.8 | — | — | — | — | 25 | 90 | 10 | 0.45 | 0.029 | 1.26 | 6–12 |
| 53 | 0.03 | 0.02 | 0.01 | — | — | — | 0.6 | 0.8 | — | — | — | — | 25 | 75 | 25 | 0.45 | 0.07 | 1.05 | 14–20 |

The cylindrical billets of the alloys Nos. 41 to 47 were each processed in the manner shown in FIG. 3. At step 111 the billet was extruded into an alloy plate at a temperature suitable for prevention of the sweating phenomenon. The extrusion temperature was within the range from 200° to 400° C. and was variable depending on the contents of the lubricating elements in the alloy. The extrusion ratio was more than 10. The extruded alloy plate was processed in the same manner as in Example 5: preliminary heat treatment at step 112 in FIG. 3, rolling at step 113, annealing at step 114, preliminary cladding with an Al sheet at step 115, annealing at 116, cladding with a steel sheet at step 117, annealing at step 118 and machining into sample bearings at step 119.

In the bearing alloys Nos. 41 to 47 produced in this example the amounts of the lubricating elements, reinforcing elements and Si were as shown in Table 3, and the grain sizes of the lubricating elements were not larger than 8 μm.

Figure 5:
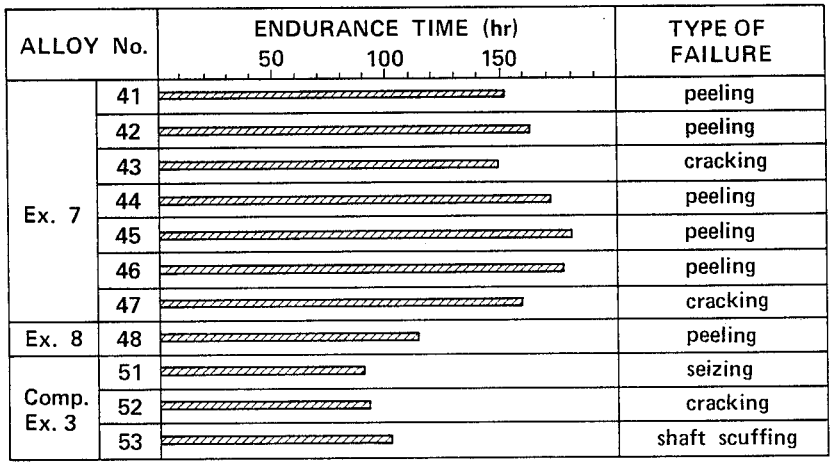
FIG. 5 is a chart showing the results of the same fatigue resistance test on several kinds of bearing alloys produced in Examples 7 and 8 and Comparative Example 3.

The sample bearings were subjected to the fatigue resistance test under the conditions described in Example 5. The test results are shown in FIG. 5.

EXAMPLE 8

This example is supplemental to Example 7 and relates to an aluminum base bearing alloy No. 48 the particulars of which are shown in Table 3. The alloy No. 48 can be taken as a modification of the alloy No. 46 of Example 7. The aluminum base alloy powder (I) used for producing the alloy No. 48 contained Si in addition to the lubricating elements and reinforcing elements used in the case of the alloy No. 46. The alloy powder (I) was obtained by the air atomizing method and consisted of −18 mesh particles. Without mixing with any other alloy powder corresponding to the Al-Si alloy powder (II) in Example 7, the Si-containing aluminum base alloy powder (I) alone was compacted into a cylindrical billet 100 mm in diameter and 100 mm in length by application of a hydrostatic pressure of 2000 kgf/cm$^2$ at normal temperature. The Si-containing alloy powder (I) was used without any heat treatment, so that the grain size of Si was not larger than 3 μm.

The sample bearings of the bearing alloy No. 48 too were subjected to the fatigue resistance test described in Example 5. The test result is shown in FIG. 5.

COMPARATIVE EXAMPLE 3

Three kinds of aluminum base bearing alloys, viz. Nos. 51 to 53 of the particulars shown in Table 3 were prepared and processed in accordance with Example 7 except the following modifications.

The alloy No. 51 and the alloy No. 52 were identical in chemical composition to the alloy No. 42 of Example 7. In the case of the alloy No. 51 the heat treatment conditions were changed so that the grain sizes of the lubricating elements were 10-μm. In the case of the alloy No. 52 the extrusion ratio was decreased to 8. The alloy No. 53 was identical in chemical composition to the alloy No. 43 of Example 7 and was larger in the grain size of Si.

Sample bearings of the alloys Nos. 51 to 53 were subjected to the fatigue resistance test described in Example 5. The test results are shown in FIG. 5.

As can be seen in FIG. 5, the bearing alloys Nos. 41 to 47 produced by the preferred second method according to the invention were excellent in fatigue resistance and durability. By comparison, the bearing alloy No. 48 produced by a different method was lower in fatigue resistance by reason of the small grain size of Si. The comparative bearing alloys Nos. 51, 52 and 53, which are remarked above, all proved to be inferior in durability or conformability.

What is claimed is:

1. A method of producing an aluminum base bearing alloy comprising the steps of:

heating a powder of a first aluminum base alloy consisting essentially of 8–12 wt% of Pb, 0.4–1.8 wt% of Sn, 1.0–15 wt% of Si, 0.2–5.0 wt% of at least one reinforcing element selected from the group consisting of Cu, Cr, Mg, Mn, Zn and Fe and the balance of Al at a temperature in the range from 350° to 550° C. until the Si grains in the alloy powder grow to 6–12 μm;

after the heating step, mixing the first aluminum base alloy powder with a powder of a second aluminum base alloy which contains at least one lubricating element selected from the group consisting of Pb, Sn, In, Sb and Bi;

compacting said alloy powder mixture into a billet;

extruding said billet at an extrusion ratio not lower than 10; and the mixing of the first and second aluminum base alloy powders and the extrusion of said billet being made such that in the extruded aluminum base alloy the content of Si is in the range from 0.01 to 0.17 by sectional area ratio to the aluminum matrix and the total content of Pb and Sn as essential lubricating elements and In, Sb and Bi as optional lubricating elements is more than 0.04 and not more than 0.07 by sectional area ratio to the aluminum matrix, while the total content of said at least one reinforcing element is 0.2–5.0 wt%, in the extruded alloy the grain size of Si being not larger then 12 μm and the grain size of every lubricating element being not larger than 8 μm.

2. A method according to claim 1, wherein said second aluminum base alloy contains 10–20 wt% of Sn.

3. A method according to claim 2, wherein said second aluminum base alloy contains 1.0–15 wt% of Si.

4. A method according to claim 2, wherein said second aluminum base alloy contains 0.2–5.0 wt% of said at least one reinforcing element.

5. A method according to claim 2, wherein said second aluminum base alloy contains at least one refining agent selected from the group consisting of Ti, B, Zr, V, Ga, Sc, Y and the rare earth elements of atomic Nos. through 57 to 71.

6. A method according to claim 2, wherein said second aluminum base alloy contains 1–4 wt% of Pb together with said Sn.

7. A method according to claim 1, wherein said billet is extruded at a temperature in the range from about 200° C. to about 600° C.

8. A method according to claim 1, further comprising the step of annealing the extruded alloy at a temperature in the range from 350° to 550° C.

9. A method according to claim 1, wherein each of the powders of said first and second aluminum base alloys is an atomized powder.

10. A method of producing an aluminum base bearing alloy, comprising the steps of:

heating a first of an Al-Si binary alloy containing 8–30 wt% of Si at a temperature in the range from 350° to 550° C. until the Si grains in the alloy powder grow to 6–12 μm;

after the heating step, mixing the Al-Si alloy powder with a second powder of another aluminum base alloy which contains at least one lubricating element selected from the group consisting of Pb, Sn, In, Sb and Bi and at least one reinforcing element selected from the group consisting of Cu, Cr, Mg, Mn, Ni, Zn and Fe;

compacting said alloy powder mixture into a billet;

extruding said billet at an extrusion ratio not lower than 10; and the mixing of the Al-Si alloy powder and the other aluminum base alloy powder and the extrusion of said billet being made such that in the extruded aluminum base alloy the content of Si is in the range from 0.01 to 0.17 by sectional area ratio to the aluminum matrix and the total content of said at least one lubricating element is more than 0.04 and not more than 0.07 by sectional area ratio to the aluminum matrix, while the total content of said at least one reinforcing element is 0.2–5.0 wt%, in the extruded alloy the grain size of Si being not larger than 12 μm and the grain size of every lubricating element being not larger than 8 μm.

11. A method according to claim 10, wherein the content of Si in said Al-Si binary alloy and the proportion of the powder of said Al-Si binary alloy to the powder of said another aluminum base alloy are controlled such that the amount of Si in the produced aluminum base bearing alloy falls in the range from 0.01 to 0.08 by sectional area ratio to the aluminum matrix.

12. A method according to claim 10, wherein said another aluminum base alloy contains at least one refining element selected from the group consisting of Ti, B, Zr, V, Ga, Sc, Y and the rare earth elements of atomic Nos. through 57 to 71.

13. The method according to claim 10, wherein said another aluminum base alloy contains Si.

14. A method according to claim 10, wherein said billet is extruded at a temperature in the range from about 200° C. to about 600° C.

15. A method according to claim 10, further comprising the step of annealing the extruded alloy at a temperature in the range from 350° to 550° C.

* * * * *